United States Patent [19]

Ek

[11] 4,171,685

[45] Oct. 23, 1979

[54] HOT WATER OR STEAM BOILER

[75] Inventor: Finn U. Ek, Osby, Sweden

[73] Assignee: Osby Varme AB, Osby, Sweden

[21] Appl. No.: 853,906

[22] Filed: Nov. 22, 1977

[30] Foreign Application Priority Data

Sep. 23, 1977 [SE] Sweden ..... 7710690

[51] Int. Cl.[2] ..... F22B 11/02

[52] U.S. Cl. ..... 122/42; 122/348

[58] Field of Search ..... 122/1 R, 42, 43, 235 R, 122/348

[56] References Cited

U.S. PATENT DOCUMENTS

| | | | |
|---|---|---|---|
| 811,785 | 2/1906 | Meurisse | 122/43 |
| 2,038,580 | 4/1936 | LaMont | 122/1 |
| 3,012,548 | 12/1961 | Guszmann | 122/235 |
| 3,918,410 | 11/1975 | Backman | 122/348 |

FOREIGN PATENT DOCUMENTS

| | | | |
|---|---|---|---|
| 637574 | 1/1928 | France | 122/235 |

*Primary Examiner*—Kenneth W. Sprague

[57] ABSTRACT

Hot water or steam boiler comprising a furnace section and a convection section in which the furnace section is limited by a wall section formed of liquid or steam tubes placed side by side, said tubes being arranged transversal to the flue gas flow and at fixed interrelated distances to form slots allowing passage of gas or steam.

11 Claims, 2 Drawing Figures

HOT WATER OR STEAM BOILER

Figure 1:
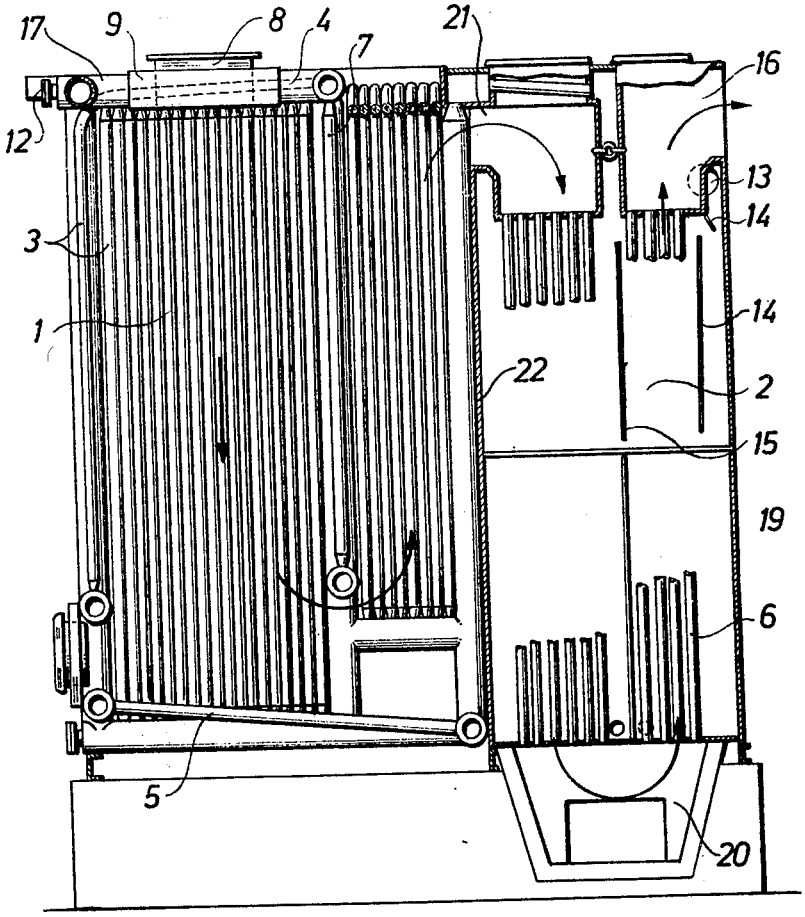

The invention concerns a development of the hot water or steam boiler, disclosed in patent application Ser. No. 777,676, U.S. Pat. No. 4,123,995 comprising a furnace section and a convection section.

Said application refers to a boiler, in which the furnace section is limited by a wall section formed of liquid or steam tubes placed side by side, while the convection section has at least one liquid or steam chamber, communicating with said liquid or steam tubes and having a big volume in relation to said tubes, through which chamber there run flue gas tubes eventually communicating with said furnace section eventually through flue gas chambers, said tubes being sealed off from the liquid or steam chamber.

According to the main application the furnace section of the boiler also includes a wall section formed by liquid or steam tubes and arranged across the heat emitting gas media, e.g. flue gas, said wall section deflecting the gas current, causing this to follow the heat absorbing medium containing tubes during a longer part of its path within the furnace section.

The object of this invention is to form the two parts of the furnace section formed by the cross wall as a fuel chamber and an after-burning chamber respectively.

According to the invention this is achieved thereby that the tubes of the furnace section, consisting of liquid or steam tubes, forming the wall are arranged transversal to the gas flow of the heat emitting medium, said tubes being arranged in a fixed interrelated distance and so forming slots for allowing passage of gas or steam.

By this is achieved partly that the form of the fuel chamber of the furnace section may be closely adapted to the fuel intended to be used so that the heat absorbing tube walls of the furnace section as well as the heat absorbing tubes of the transversal wall will be in close relation to the fuel, so that an intense heat exchange is achieved between the fuel and the heat absorbing tubes. Especially in humid fuel, such as wood, this is advantageous for drying and preheating the fuel.

The after-burning chamber of the furnace section formed by the cross wall is thus completely mechanically separated from the fuel chamber but communicates with the fuel chamber through the slots between the heat absorbing tubes of the cross wall, so that steam or volatile gases developed at pre-heating and burning of the fuel may be transferred directly from the fuel chamber to the after-burning chamber in order to be completely burnt in the main gas flow.

According to one embodiment of the invention is also achieved that solid fuel is easily settling downwards towards the roost during the burning by making the liquid or steam tubes of the cross wall mainly vertical.

In testing a boiler according to the invention it has proven especially advantageous to have a slot-width of about 2–5% of the outer diameter of the heat transferring tubes of the cross wall.

The invention will be more closely disclosed in relation to the attached drawings.

Figure 2:
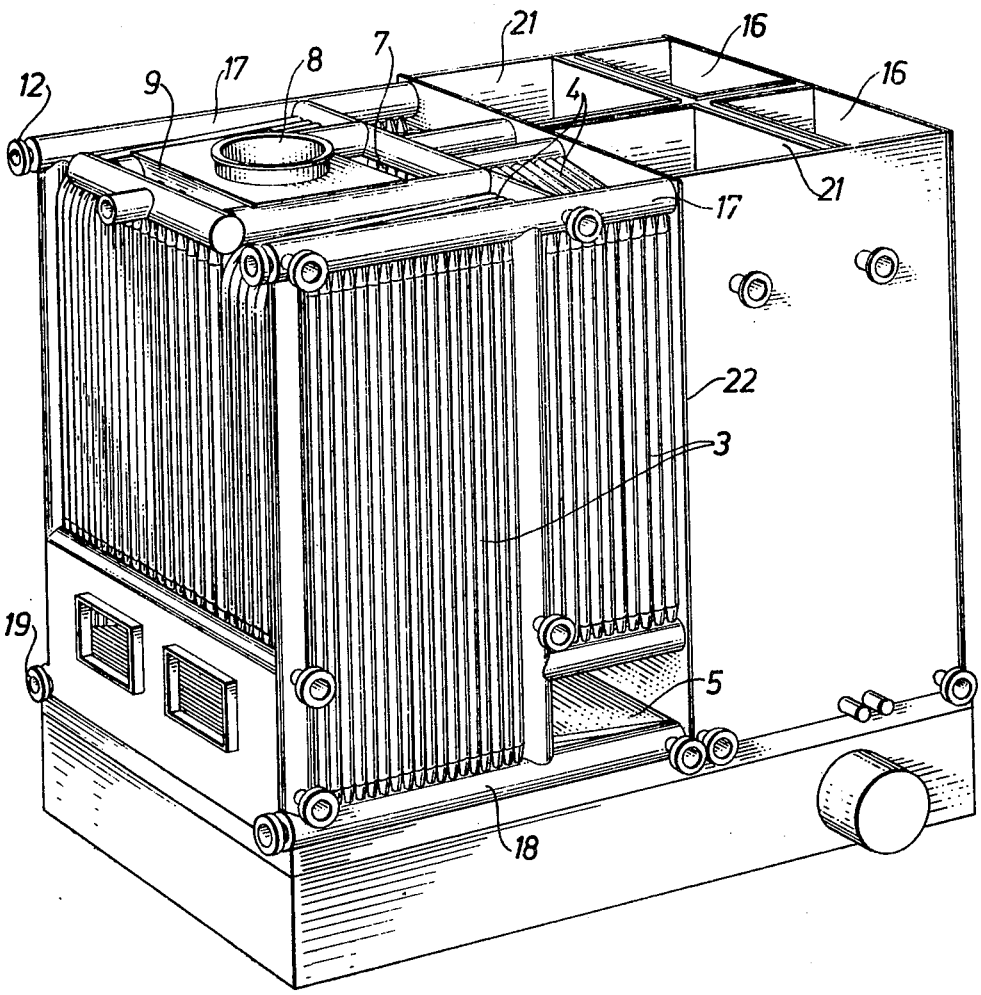

FIG. 1 is an embodiment of the invention, having the furnace section divided into two chambers and the convection section incorporating a liquid or steam-cooled chamber, being traversed by vertical flue gas tubes and FIG. 2 showing an embodiment according to FIG. 1 in perspective.

As shown in FIGS. 1 and 2 in the boiler according to this embodiment the section of the boiler being exposed to the heaviest thermal stresses, i.e. the furnace section 1, formed as a water tube section having wall areas formed by liquid or steam tubes 3, forming side-walls, tubes forming ceiling areas and tubes 5 forming bottom areas. These tubes 3, 4 and 5 are flowed through by liquid or steam and their ends are hermetically (e.g. by welding) joined to collecting boxes 17, 18 for the heat absorbing medium in liquid or steam form.

By a corresponding wall section 7, also formed by liquid or steam tubes, the furnace section is divided into a fuel chamber and an after-burning chamber, said tubes being arranged at a given relative distance so that slots are formed for letting gas or steam through.

The convection section 2 is formed by plane or cylindrical walls, which enclose a liquid or steam chamber 19 (FIG. 1), being traversed by flue gas tubes 6 communicating with the furnace section 1 via flue gas chambers 16 and 21, said flue gas tubes 6 being sealed in relation to the liquid or steam chamber 19.

Being connected to the flue gas chambers 16 and 21 the tubes 6 form two or more groups of tubes, the lower parts of which end in a common flue gas chamber 20. In deflecting the flue gases from the flue gas chamber 21 downwards through the left group of flue gas tubes in FIG. 1 to the flue gas chamber 20 and upwards through the group of flue gas tubes to the right in FIG. 1 to the flue gas chamber 16 and further to the chimney, the path of the flue gases may be extended and a repeated heat transfer to the heat carrying medium in the liquid or steam chamber 19 can be achieved.

The hot water or steam boiler shown may use liquid, gaseous and/or solid fuel. In using oil or gas firing the firing unit may be mounted in the ceiling passage way 8 of the boiler. The furnace section in this case constitutes a flame chamber. However, the boiler specified renders a fast transfer to firing with domestic fuels possible in the event of blockade of imported fuels. In this case the furnace section 1 serves as a fuel chamber for wood or coal. The re-filling in this case is done through the top hatch 9. The bottom of the furnace section, consisting of water tubes 5, may either directly or after complementary addition serve as a fire grate section.

By the wall 7 the fuel chamber may be adapted to the fuel intended to be used.

Although the invention has been specified with reference to some of its embodiments it may nevertheless be arbitrarily varied within the scope of the subsequent patent claims.

I claim:

1. A boiler for steam or hot water comprising a furnace section defined substantially in its entirety by top, bottom and sidewalls formed of closely arranged horizontally and vertically extending liquid or steam tubes respectively;

a plurality of vertically extending and horizontally spaced liquid or steam tubes positioned within said furnace section to form a partition wall dividing same into first and second chambers, said partition wall extending transversely to the flow of combustion gases;

said horizontally and vertically extending tubes by the aforesaid arrangement being exposed to combustion radiation and flue gases within said furnace section;

a convection section positioned laterally of said furnace section including at least one chamber for liquid or steam;

convecting means for operatively connecting said furnace and convection sections to permit the flow of liquid or steam between said tubes and said chamber of the convection section;

means for conducting flue gases from said furnace chamber to said convection section; and a plurality of flue gas tubes within said convection section arranged therewithin to conduct flue gases from said furnace chambers in a substantially U-shaped path through the liquid or steam chamber for heat exchange with the liquid or steam therewithin.

2. A boiler according to claim 1 wherein said partition wall thereby defines one of said furnace chambers as a chamber for the combination of solid fuel making possible an uninterrupted magazine firing.

3. A boiler according to claim 2, wherein the other furnace chamber located downstream from said one chamber constitutes an after-burning chamber for the boiler.

4. A boiler according to claim 1 wherein the tubes of said partition wall are spaced by slots having a width which amount to 2–5% of the outer diameter of the tubes.

5. A boiler according to claim 1 wherein said furnace and convection sections are fabricated as separate units and are assembled in side-by-side positional relationship to thereby form said boiler.

6. A boiler according to claim 5, including complementary connecting surfaces on said furnace and convection sections to facilitate assembly thereof.

7. A boiler according to claim 6, wherein said complementary surfaces are planar.

8. A boiler according to claim 1, including an opening in the sidewall of said furnace permitting discharge of flue gases from at least one of said furnace chambers.

9. A boiler according to claim 1, including return pipe means for recycling liquid or steam to said convection section and baffle members within said convection section for diverting recycled liquid or steam downwardly therewithin into the chamber for liquid or steam and preventing impingement on said flue gas tubes.

10. A boiler according to claim 1, including at least one flue gas chamber in the upper portion of said convection section, said flue gas tubes extending from said flue gas chamber and through said chamber for liquid or steam.

11. A boiler according to claim 10, including a second flue gas chamber below said chamber for liquid or steam a first group of flue gas tubes connecting said first and said second flue gas chambers, and a second plurality of flue gas tubes connecting said second flue gas chamber with a discharge opening in said convection section for discharge of the flue gases to a chimney.

* * * * *